US005573411A

United States Patent [19]

Bartosz et al.

[11] Patent Number: 5,573,411

[45] Date of Patent: Nov. 12, 1996

[54] BUILT-IN PLUG WITH A GROUNDING WIRE CONTACT PIN

[75] Inventors: Josef Bartosz, Markdorf; Wolfgang Mehnert, Lindau, both of Germany

[73] Assignee: i f m electronic GmbH, Germany

[21] Appl. No.: 455,853

[22] Filed: May 31, 1995

[30] Foreign Application Priority Data

May 31, 1994 [DE] Germany ..... 44 19 023.9

[51] Int. Cl.[6] ..... H01R 4/66

[52] U.S. Cl. ..... 439/95; 439/96; 439/108

[58] Field of Search ..... 439/95, 106, 96, 439/97, 108, 608

[56] References Cited

U.S. PATENT DOCUMENTS

| | | | |
|---|---|---|---|
| 3,381,258 | 4/1968 | Becker, Jr. . | |
| 4,407,553 | 10/1983 | Dvorachek et al. . | |
| 5,151,035 | 9/1992 | Kawai et al. | 439/95 |
| 5,181,860 | 1/1993 | Honma et al. | 439/95 |
| 5,449,302 | 9/1995 | Yarbrough et al. | 439/95 |
| 5,453,016 | 9/1995 | Clark et al. | 439/79 |

FOREIGN PATENT DOCUMENTS

| | | |
|---|---|---|
| 89060946 | 8/1989 | Germany . |
| 3912189 | 5/1992 | Germany . |
| 92077382 | 10/1992 | Germany . |

*Primary Examiner*—P. Austin Bradley
*Assistant Examiner*—T. C. Patel
*Attorney, Agent, or Firm*—Sixbey, Friedman, Leedom & Ferguson, P.C.; David S. Safran

[57] ABSTRACT

A built-in plug with a grounding wire contact pin (3) is located on and projects from a plug side of a plug housing (2), and is designed for connection to an electrically conductive housing (5) of a part (6) into which the plug is to be incorporated. To make available a built-in plug which essentially corresponds to the current safety standard, and which therefore has the required creepage distances and clearances, it is provided that grounding wire contact pin (3) is electrically connected to a grounding wire element (9) which is routed to an outer surface (8) of the plug housing (2) and which is used for contacting the conductive housing (5) of part (6) into which the plug is to be incorporated.

19 Claims, 4 Drawing Sheets

FIG. 3
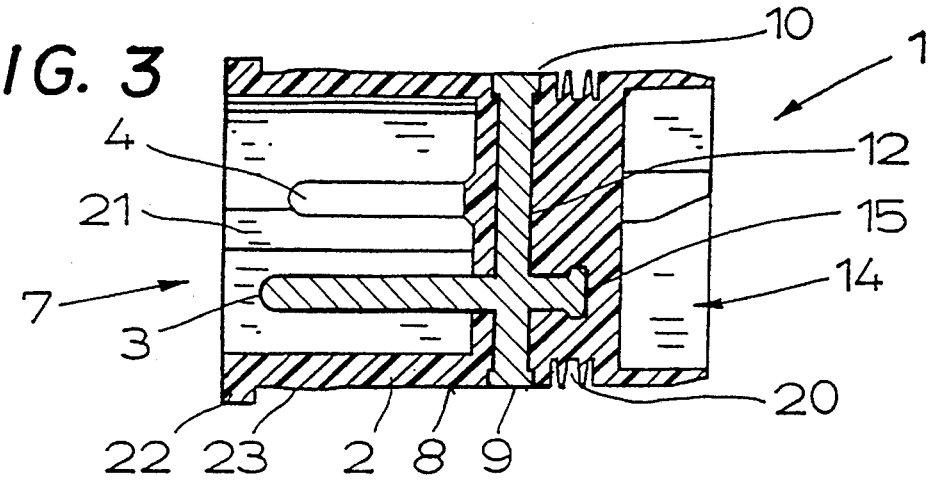
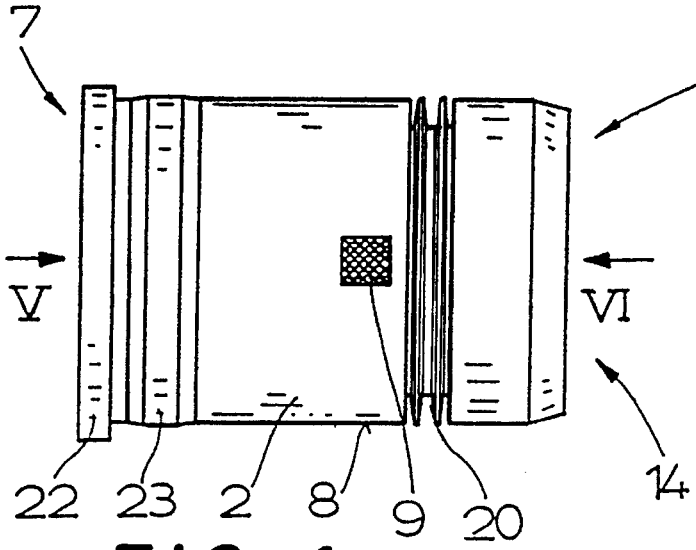
FIG. 4
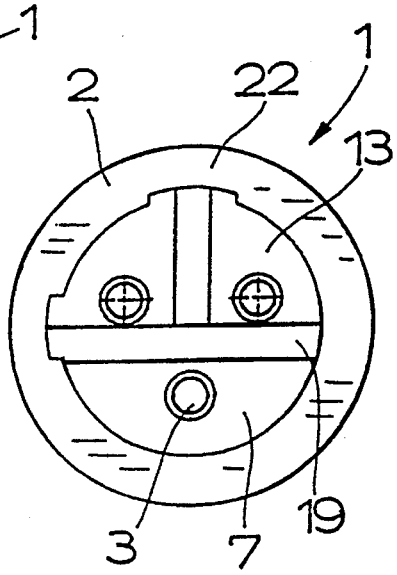
FIG. 5
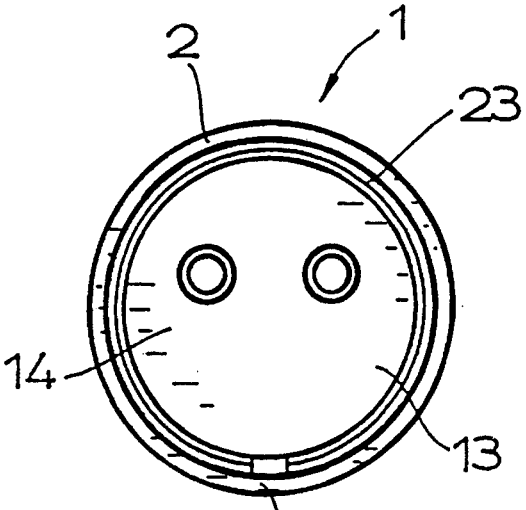
FIG. 6
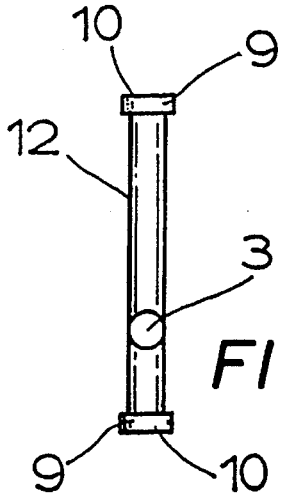
FIG. 7

BUILT-IN PLUG WITH A GROUNDING WIRE CONTACT PIN

BACKGROUND OF THE INVENTION

1. Field of the Invention

The invention relates to a built-in plug with a grounding wire contact pin which projects on the plug side and which is located in a plug housing forming a connection receptacle.

2. Description of Related Art

Built-in plugs of the aforementioned type are already known as part of plug connections. These built-in plugs are used for electronic and electrical parts of any type, for example, for proximity switches. The structure of these built-in plugs is generally always the same. Thus, normally several active contact pins together with a grounding wire contact pin, which is normally leading on the plug side, are provided. Moreover, known built-in plugs generally have a cable box with a gasket and union nut. The grounding wire contact pin thus penetrates the built-in plug, i.e., it is accessible on the plug and on the solder side. On the solder side, this contact pin must then be continued through a second or third part up to the so-called "accessible" surface as a protective contact and must be connected to the latter.

Known built-in plugs have a series of, in part, significant disadvantages. Thus, for example, the VDE-compatible creepage distances and clearances are in part largely not achieved. The inadequate creepage distances and clearances are caused especially by the fact that the active pins and grounding wire contact pin on the solder side are located too close to one another due to a fixed and stipulated connection pattern. As the result of deviations from the required set-points of the creepage distances and clearances, various of the known built-in plugs do not satisfy requirements of safety class I (according to IEC 536, DIN VBE 0106T, 1A1) and thus represent a safety risk.

Furthermore, built-in plugs are known from practice in which the grounding wire contact pin is pressed onto the housing to be protected only in conjunction with a plastic pin carrier. In case of a fault, specifically when the plastic insert softens due to heat, the pressure force is cancelled and thus also grounding wire contacting.

Additionally, various mechanical problems exist in known built-in plugs. One fundamental problem is that different built-in plugs do not have sufficient torsional resistance. This means that, when the plug is twisted, there is the danger that an active pin will come into contact with the grounding wire contact pin, by which equipment safety suffers. To prevent this problem, specially designed mounting sleeves and adapters are necessary which are designed to guarantee mechanical torsion resistance. Besides the additional individual parts necessary for this purpose, costs are also higher.

Moreover, another problem consists in that the installation process, when assembling the built-in plug, is not inherently reproducible since contact of the grounding wire contact pin with the housing is generally closed by soldering. Moreover, in this type of connection of the grounding wire contact pin to the housing, there is no adequate checking whether soldering always satisfies the thermal and mechanical requirements in case of a fault. Finally, many built-in plugs have no plug vent, by which complete sealing of the pertinent parts, for example, of proximity switches, becomes impossible.

SUMMARY OF THE INVENTION

Thus, is a primary object of the present invention to provide a built-in plug with a ground contact that is not subject to the mentioned shortcomings of known plugs of this type.

This object is achieved according to the invention by taking a new approach, the basic idea of which is that, in the built-in plug specified initially, it is provided the grounding wire contact pin is electrically connected to a grounding wire element which is routed to an outer surface of the plug housing and which is used for contacting with housing of part. Therefore, the invention is based on the general idea of routing a grounding wire contact pin located on the plug side inside the plug to the outside on the solder side. The invention is thus based, first of all, on the finding that the mentioned safety problems lie in the construction of the built-in plugs themselves and cannot be eliminated, or only inadequately so, by external, user-specific measures such as additional sealed insulation or welded-in insulators.

In the invention, therefore, the built-in plug is provided with integrated grounded wire contacting, the grounding wire contact pin in the built-in plug being routed through an integrated grounding wire element to the outside of the plug; this can make contact directly with the housing there. The connection to the conductive housing can be established by a reliable interference fit in plug installation. The additional working step of "soldering" and the associated disadvantages are thus eliminated. Therefore, a completely new solution is made available by the grounding wire element being integrated into the built-in plug on the plug outer surface which is conductively connected to the grounding wire contact pin.

It is important that the built-in plug according to the invention have an external geometry and a connector pattern (plug side) which remain unchanged. The built-in plug according to the invention corresponds to one without the grounding wire only on the solder side. Since no additional parts are necessary to effect contact between the grounding wire and housing, the number of individual-parts required is reduced. Moreover, production costs in equipment assembly is reduced. Since soldering of the grounding wire contact pin is no longer necessary, reproducible manufacture of this product results with increased technical safety. Reliable control of creepage distances and clearances in conformance with standards is possible, especially on the solder side.

Furthermore, increased protection in case of a fault, i.e., in case of fire and chemical destruction of the insulated plug housing, is possible since the grounding wire element does not need the plug housing as a "carrier" for contacting of the housing. Furthermore, a good sealing of the plug to the housing is possible. In this case, the same closeness can be achieved as in plugs without grounding wires. Since the geometry of the plug according to the invention (on the solder side) and a plug without the grounding wire is the same, corresponding interchange in equipment installation is possible (modular technique), if necessary. Existing series produced devices can thus be easily retrofitted to the flush type plugs according to the invention. Since, on the solder side, there is no grounding wire contact pin in the housing, them is no danger of contact with an active pin when the plug is twisted.

In addition, it is easily possible to guarantee torsion resistance of the plug by corresponding forces of pressure when the built-in plug is pressed into the housing of the part. This can be done especially by profiling (for example, knurling) of the grounding wire element. The plug according to the invention, and especially the grounding wire element, can be easily built using general production technologies, so that the costs incurred in the manufacture of the built-in plug according to the invention are low.

Other features, advantages and applications of this invention will be apparent from the following description of embodiments when considered in conjunction with the accompanying figures of the drawings.

BRIEF DESCRIPTION OF THE DRAWINGS

FIG. 3 is a cross-sectional view of the built-in plug from FIG. 1;

FIG. 4 is an top plan view of the built-in plug from FIG. 3.

FIG. 5 is an end view of the built-in plug in the direction of arrow V in FIG. 4 (plug side);

FIG. 6 shows a view of the built-in plug in the direction of arrow VI from FIG. 4 (solder side);

FIG. 7 shows a view of the grounding wire element of the built-in plug from FIG. 3;

DETAILED DESCRIPTION OF THE PREFERRED EMBODIMENTS

Figure 1:
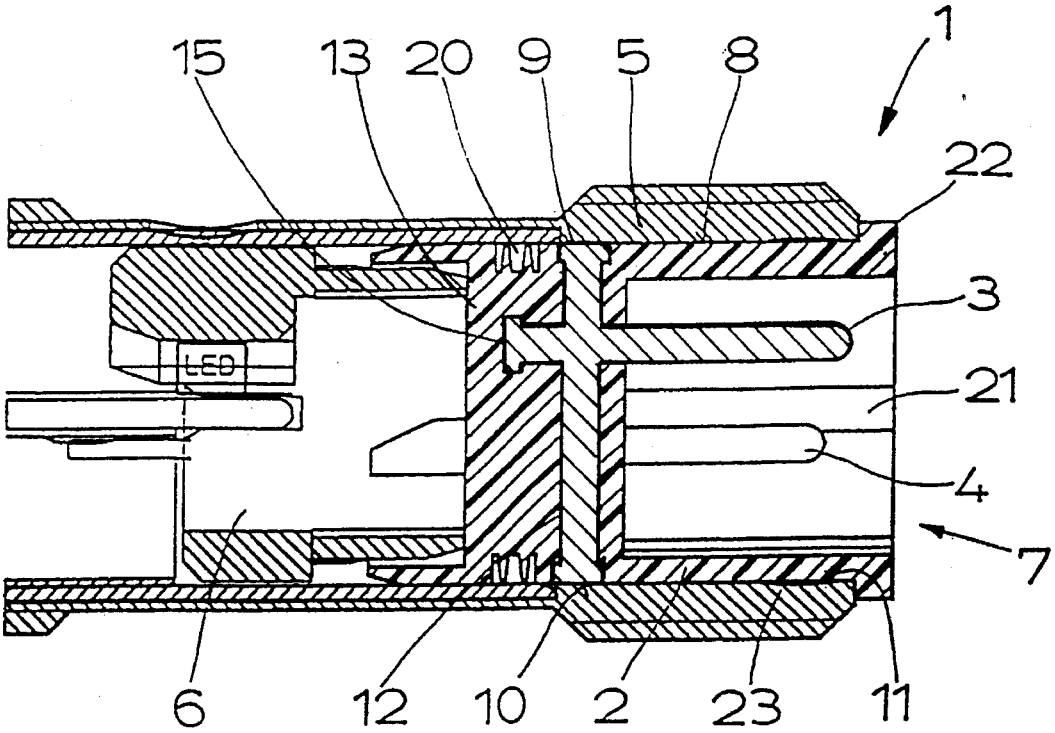
FIG. 1 is a cross-sectional view of a built-in plug according to the invention in the installed state.
Figure 2:
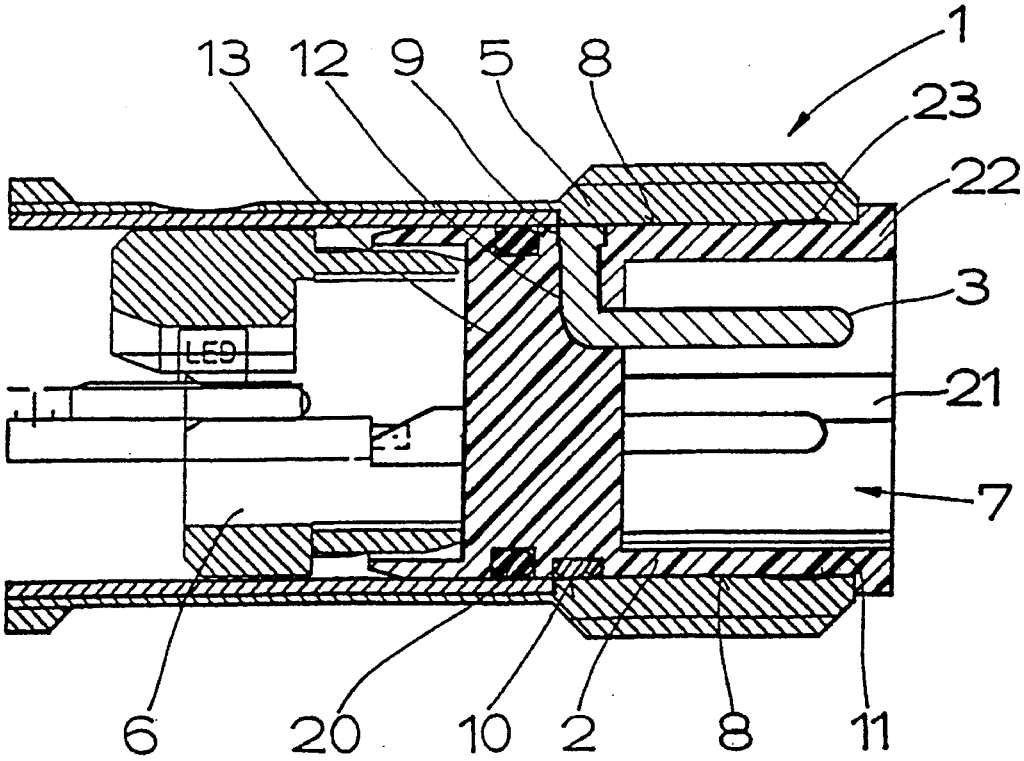
FIG. 2 is a cross-sectional view of another embodiment of a built-in plug according to the invention in the installed state.

FIGS. 1 and 2 show two built-in plugs 1 according to the invention in the installed state. Each of the built-in plugs 1 is provided with a grounding wire contact pin 3 which projects on the plug side and which is located in a connection receptacle of a plug housing 2. The plug housing 2 in which grounding wire contact pin 3 is located is made of an electrically insulating plastic. In addition to grounding wire contact pin 3, there are additional contact pins 4 in the connection receptacle of the housing 2 of the built-in plug 1. The grounding wire contact pin 3 is provided for connection to electrically conductive housing 5 of part 6 which is only partially shown. Part 6 can be, for example, a proximity switch.

At this point, it is significant that the grounding wire contact pin 3, which projects on plug side 7, is routed to the outside following plug side 7 and for this reason is electrically or conductively connected to grounding wire element 9 which runs to the outer surface 8 of plug housing 2. The grounding wire element 9 is used for making contact with housing 5 of part 6. For direct outside contacting, the built-in plug according to the invention, therefore, has an integrated grounding wire element 9. Electrical connection to housing 5 of part 6 takes place preferably by an interference fit. A reliable interference fit, and thus a connection to conductive housing 5, can be easily accomplished during plug installation; this simplifies the installation process overall.

When the grounding wire element 9 has an outside contact area 10 which preferably projects slightly beyond the adjacent outer surface 8, a grounding wire connection results with a defined fit, and thus, also with a defined contact pressure forces when built-in plug 1 is pressed into housing 5. In doing so, it is especially advantageous if the grounding wire element 9 is profiled, preferably knurled axially, knurled diagonally, or arched. Profiling increases the torsion resistance of the built-in plug according to the invention.

Figure 9:
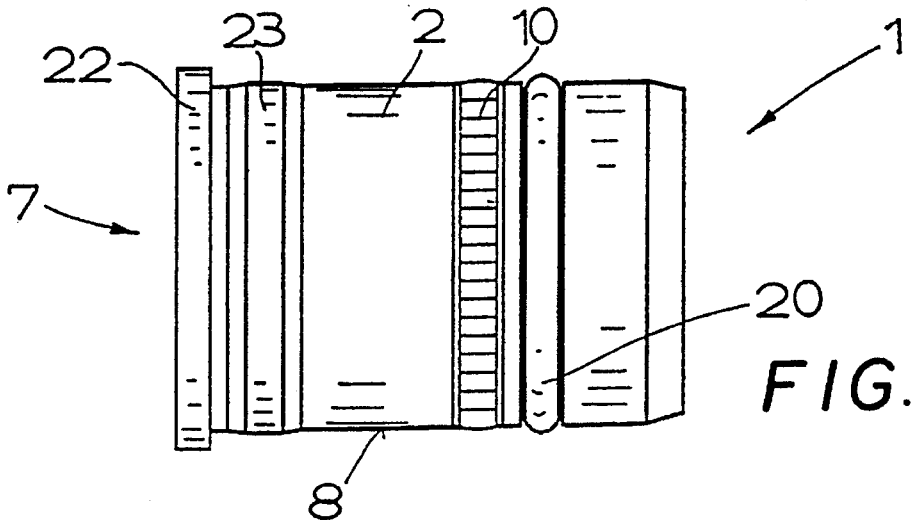
FIG. 9 is an elevational view of the built-in plug of FIG. 8.

Grounding wire element 9, itself, can fundamentally have a host of different forms. In particular, a peripheral closed or open ring or formation of at least one optionally flat ring segment is advantageous. This yields, overall, a large contact surface. Moreover, external contact area 10, on the transition to outer surface 8, is bevelled (compare FIG. 9). By bevelling in the transition from the grounding wire element 9 to the plug housing 2, pressing, and thus the capacity of built-in plug 1 to be installed in installation opening 11 of the housing 5 provided for this purpose, are improved.

Furthermore, a connecting element 12 which runs roughly perpendicularly to grounding wire contact pin 3 is provided for electrical and mechanical connecting of the grounding element 9 to grounding wire contact pin 3. In the installed state, the grounding wire contact pin 3, connecting element 12 and grounding wire element 9, which has contact area 10, form a single, rigid part. This design ensures that the protective function of the built-in plug 1 is preserved in the case of a fault, i.e., fire or chemical destruction of plastic plug housing 2. Connection of grounding wire contact pin 3 with housing 5 of part 6 is therefore preserved regardless of whether, at this point, plastic parts of plug housing 2 are destroyed or not, since grounding wire element 9 is self-supporting at least in conjunction with connecting element 12.

Plug housing 2, conventionally, has a carrier wall 13 which not only separates plug side 7 from solder side 14 (FIG. 3), but also carries grounding wire contact pin 3 and contact pins 4. In contrast to known built-in plugs, grounding wire contact pin 3, however, does not extend through the carrier wall 13 of the built-in plug 1 according to the invention. This means that grounding wire contact pin 3 is not visible on the solder side 14 of the built-in plug.

As is apparent from FIG. 6, built-in plug 1 according to the invention, seen from solder side 14, looks like a plug without a grounding wire contact pin. Since grounding wire contact pin 3 is not present on solder side 14, there are no creepage distance and clearance problems on this side. In this case, it is provided that the grounding wire contact pin 3 is connected via connecting element 12 to grounding wire element 9 or passes into it in the area of carrier wall 13. In this way, therefore, on the one hand, the grounding wire contact pin 3 is fixed in carrier wall 13 (to do this, support areas 15 having an enlarged end can also be provided), and on the other hand, the connecting element 12 and most of grounding wire element 9, except for contact area 10, are embedded in the insulating material of the plug housing 2 and thus are insulated.

Grounding wire contact pin 3 can be formed integrally with grounding wire element 9 and connecting element 12. This applies at least to the installed state in order to guarantee the "self-bearing capacity" of this overall system if carrier wall 13 or plug housing 2 should be damaged. In FIGS. 7 and 12, and especially in the embodiments of FIGS. 12*a* through *f*, different types of the overall system formed of the "grounding wire contact pin, connecting element and grounding wire element" are shown. In the integral embodiments, the grounding wire contact pin 3, connecting element 12 and grounding wire element 9 are made as a casting, punched/bent part, or deep drawn part. In addition to this integrally manufactured design, it goes without saying that the three aforementioned parts can also be made as separate parts which are then joined to one another, for example, by cold welding, riveting, resistance welding, laser welding, plasma welding, brazing, stamping or galvanizing.

Instead of separately manufacturing all three parts, however, grounding wire contact pin 3 and connecting element 12 or connecting element 12 and grounding wire element 9 can be made integrally and then joined to the respective other part in the aforementioned manner. In this case, the grounding wire contact pin 3, grounding wire element 9 and connecting element 12 should be made of, for example, zinc, aluminum, copper and/or beryllium. Furthermore, to achieve improved contact physics, it is provided that the surface of the external contact area 10 be refined, preferably, for example, gilded, silver-plated, tin-plated, hard nickel-plated or chrome-plated.

Figure 8:
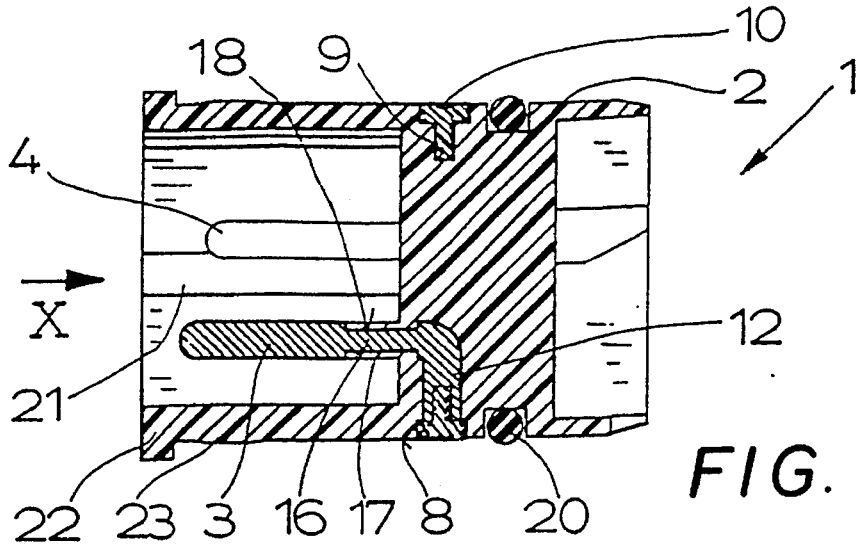
FIG. 8 is a cross-sectional view of the built-in plug from FIG. 2.

In order to increase creepage distances on the plug side, it is provided that grounding wire contact pin 3 has insulation 17, as is shown in FIG. 8, in base area 16 near carrier wall 13. In base area 16, there is a groove 18 for insulation 17. By means of groove 18, it is possible to align the insulation 17 with the grounding wire contact pin 3, so that a plug part to be inserted into the built-in plug 1 is not hindered by insulation 17 and can be pushed until it hits carrier wall 13. As is apparent especially from FIG. 5, on carrier wall 13, viewed from plug side 7, there is a profiling 19 (such as a rib or ridge) which is preferably located between all of the contact pins 4 and also the grounding wire contact pin 3. This profiling 19 is, likewise, used to increase the clearances and creepage distances. Moreover, as is not shown, on the solder side 14 of carrier wall 13, corresponding profiling can be provided.

On plug housing 2, there is peripheral seal 20. Seal 20 can, in this case, be formed as a double rib (FIG. 1), O-ring (FIG. 2), or as an injected elastomer seal. It is not shown that venting can be provided on plug housing 2 of built-in plug 1 which enables sealing of the part. Venting can be achieved, for example, via a labyrinth, holes and/or sealing hole or the like. Otherwise, the built-in plug 1 according to the invention has polarization coding 21 both on plug side 7 and on solder side 14.

Plug housing 2 has a front support flange 22 surrounding the connection receptacle. The support flange 22 provides support for the built-in plug 1 when it is pressed into the installation opening 11 of the part 6 of which the plug is to form a built-in part. Inward of the support flange 22 is a peripheral bead 23 which provides torsional resistance and integrity.

Figure 10:
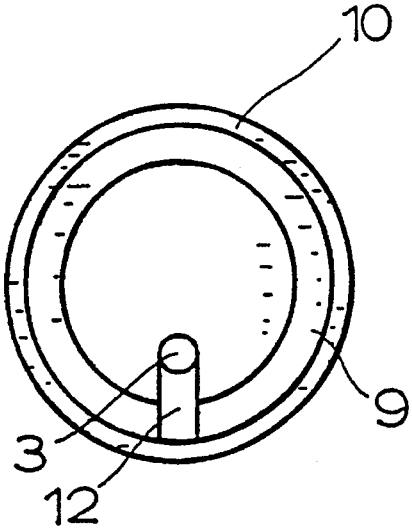
FIG. 10 is an end view of the grounding wire element with grounding wire contact pin of the built-in plug from FIG. 8.

Finally, FIG. 12 shows various units, each of which is formed of a grounding wire contact pin 3, connecting element 12 and grounding wire element 9. While in FIG. 10 grounding wire element 9 has the shape of a closed ring, in embodiments *a* and *b* of FIG. 12 an open or partial ring is provided in each case, in which the opening in the ring can be provided essentially anywhere. In the embodiment shown in a there is the ring opening is located opposite the grounding wire contact pin 3, while in the embodiment shown in *b*, it is adjacent to the grounding wire contact pin 3. In the embodiment shown in 12*c*, the grounding wire element 9 has two ring shaped segments located at opposite ends of the connecting element 12 by which they are interconnected. This embodiment is similar to the embodiment shown in FIG. 7.

Figure 11:
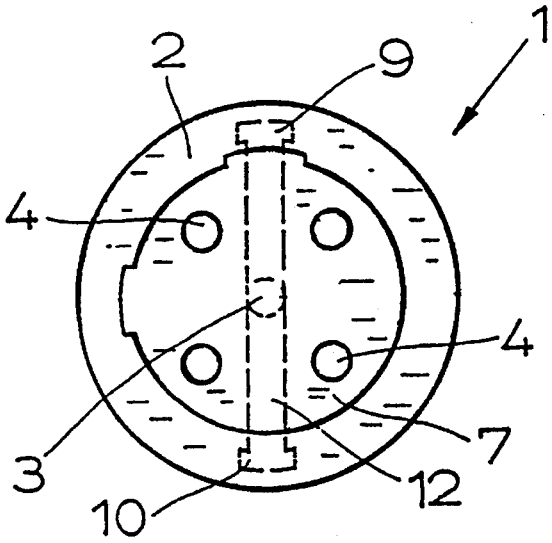
FIG. 11 is a plug-side end view of another embodiment of a built-in plug according to the invention.
Figure 12A:
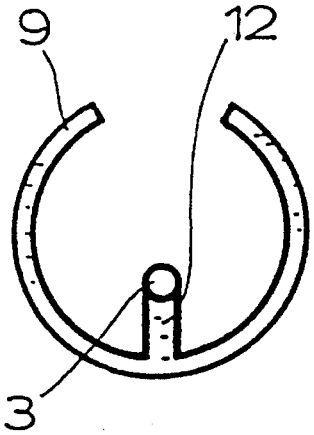
FIGS. 12*a–f* show different embodiments of grounding wire elements with grounding wire contact pins.
Figure 12B:
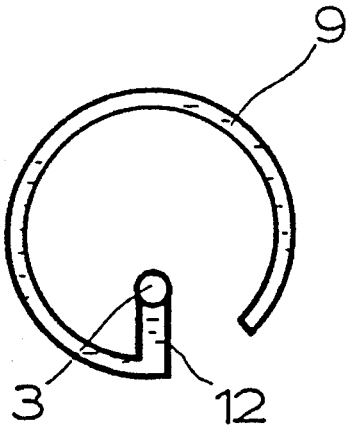
Figure 12C:
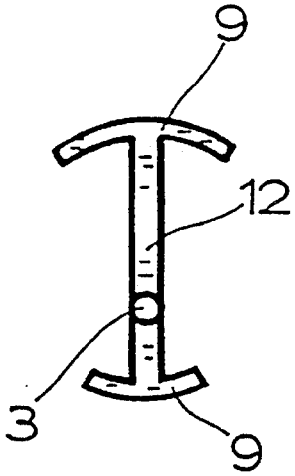
Figure 12D:
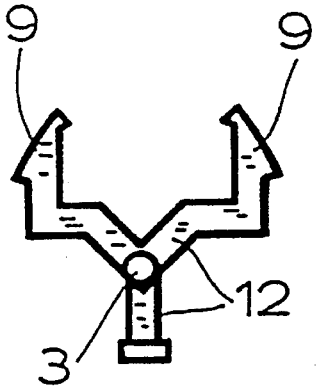
Figure 12E:
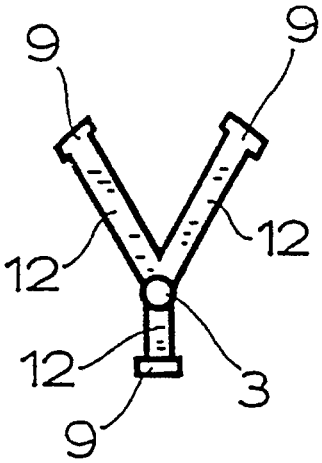
Figure 12F:
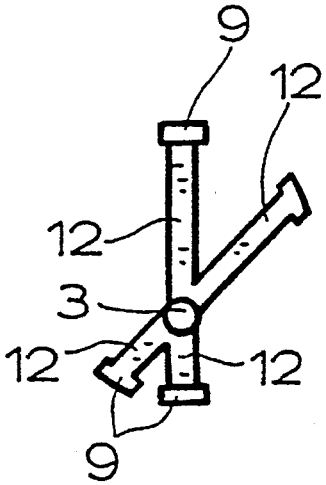

The units shown in embodiments *d* and *e* of FIG. 12 both are y-shaped, while the embodiment shown in 12*f* has an x-shape. It goes without saying that, instead of an off-center arrangement of grounding wire contact pin 3, a centered arrangement can be provided, as is, for example illustrated in FIG. 11.

While various embodiments in accordance with the present invention have been shown and described, it is understood that the invention is not limited thereto, and is susceptible to numerous changes and modifications as will be apparent to those of ordinary skill in the art. Therefore, this invention is not limited to the details shown and described herein, and includes all such changes and modifications as are encompassed by the scope of the appended claims.

We claim:

1. Built-in plug comprising a plug housing with a carrier wall, a grounding wire contact pin which projects on a plug side of said housing, which is located in said plug housing; wherein the grounding wire contact pin is electrically connected to a grounding wire element by a connecting element which is molded within said carrier wall and routed to an outer surface of the plug housing as a means for electrically connecting the grounding wire contact pin to a conductive housing of a part into which the built-in plug is incorporated; and wherein the grounding wire contact pin is formed as one piece with the grounding wire element and connecting element.

2. Built-in plug according to claim 1, wherein the grounding wire element is made of at least a ring segment.

3. Built-in plug according to claim 1, wherein the grounding wire element is made of a complete ring.

4. Built-in plug according to claim 1, wherein said connecting element runs approximately perpendicular to the grounding wire contact pin.

5. Built-in plug according to claim 1, wherein the integrally-formed grounding wire contact pin, grounding wire element and connecting element is made of one-piece as one of a casting, bent part, and deep drawn part.

6. Built-in plug according to claim 1, wherein the integrally-formed grounding wire contact pin, grounding wire element and connecting element is made of separate parts which are joined to one another by one of cold welding, riveting, resistance welding, laser welding, plasma welding, brazing, stamping and galvanizing.

7. Built-in plug according to claim 1, wherein the grounding wire contact pin, grounding wire element and connecting element are made of at least one of zinc, aluminum, copper and beryllium.

8. Built-in plug according to claim 1, wherein a peripheral seal is provided on the plug housing.

9. Built-in plug according to claim 1, wherein the plug housing has a vent.

10. Built-in plug according to claim 1, wherein a polarization coding is provided on the plug housing.

11. Built-in plug according to claim 1, wherein the electrical connection of the grounding wire element to the conductive housing is an interference fit connection.

12. Built-in plug according to claim 11, wherein the grounding wire element has an external contact area which projects beyond an outer surface of the plug housing.

13. Built-in plug according to claim 11, wherein the external contact area has a profile with one of an axial knurling, a diagonal knurling and an arched shape.

14. Built-in plug according to claim 12, wherein the external contact area has a bevelled transition to the outer surface of the plug housing.

15. Built-in plug according to claim 12, wherein the external contact area has a surface which is one of gilded, silvered, tin-plated, hard nickel-plated and chrome-plated.

16. Built-in plug according to claim 1, wherein said grounding wire contact pin is held on said carrier wall of the plug housing without extending through the carrier wall.

17. Built-in plug according to claim 16, wherein a profiling is provided on at least one side of the carrier wall.

18. Built-in plug according to claim 16, wherein the grounding wire contact pin has electrical insulation on a base area thereof near said carrier wall.

19. Built-in plug according to claim 18, wherein said insulation is provided in a groove on said base area; and wherein an outer surface of the insulation lies flush with an outer surface of the grounding wire contact pin.

* * * * *